US007647668B2

(12) United States Patent
Meyerl

(10) Patent No.: US 7,647,668 B2
(45) Date of Patent: Jan. 19, 2010

(54) DRYWALL TOOL RESULTING IN FLAT EVEN JOINT

(75) Inventor: Jay Meyerl, 140 N. Washington St., Evans City, PA (US) 16033

(73) Assignee: Jay Meyerl, Evans City, PA (US)

( * ) Notice: Subject to any disclaimer, the term of this patent is extended or adjusted under 35 U.S.C. 154(b) by 265 days.

(21) Appl. No.: 11/732,635

(22) Filed: Apr. 4, 2007

(65) Prior Publication Data

US 2008/0244855 A1 Oct. 9, 2008

(51) Int. Cl.
*B05C 17/10* (2006.01)

(52) U.S. Cl. ..... 15/245.1; 15/235.4; 15/236.01

(58) Field of Classification Search ..... 15/245.1, 15/236.01–236.03, 235.3–235.7, 105.5, 143.1, 15/DIG. 4; D8/14, 10, 25, 13, 89; D32/49, D32/46; 30/169

See application file for complete search history.

(56) References Cited

U.S. PATENT DOCUMENTS

D169,142 S * 3/1953 Bordelon ..... D13/127
2,800,672 A * 7/1957 Gilyan ..... 15/105
2,934,936 A * 5/1960 Vernon ..... 15/235.4
3,878,581 A * 4/1975 Perna ..... 15/235.7
4,654,919 A * 4/1987 Liberman ..... 15/245.1
D416,453 S * 11/1999 Egan ..... D8/45
6,389,632 B1 * 5/2002 Bergman ..... 15/105
6,606,758 B1 * 8/2003 Fridman ..... 15/245.1
D576,001 S * 9/2008 Brunderman ..... D8/19
2002/0002754 A1 * 1/2002 Wendel ..... 15/245.1

* cited by examiner

*Primary Examiner*—Shay L Karls

(57) ABSTRACT

A method and a drywall tool for making flat and even joints for the construction industry are disclosed. This innovative hand tool for making flat even joints includes a central section that is a cut out notch allowing for an extruded amount of drywall compound that produces a sufficient width and height to be placed over the drywall tape within the drywall recessed or butt joints. Once this cures, a simple fill in step using a standard towel allows these process steps to be accomplished by an unskilled worker, while producing flat and even joints, requiring less time, and dust.

2 Claims, 2 Drawing Sheets

DRYWALL TOOL RESULTING IN FLAT EVEN JOINT

FEDERAL SPONSER RESEARCH

Not Applicable

SEQUENCE LISTING OR PROGRAM

Not Applicable

BACKGROUND

1. Field of Invention

Figure 1:
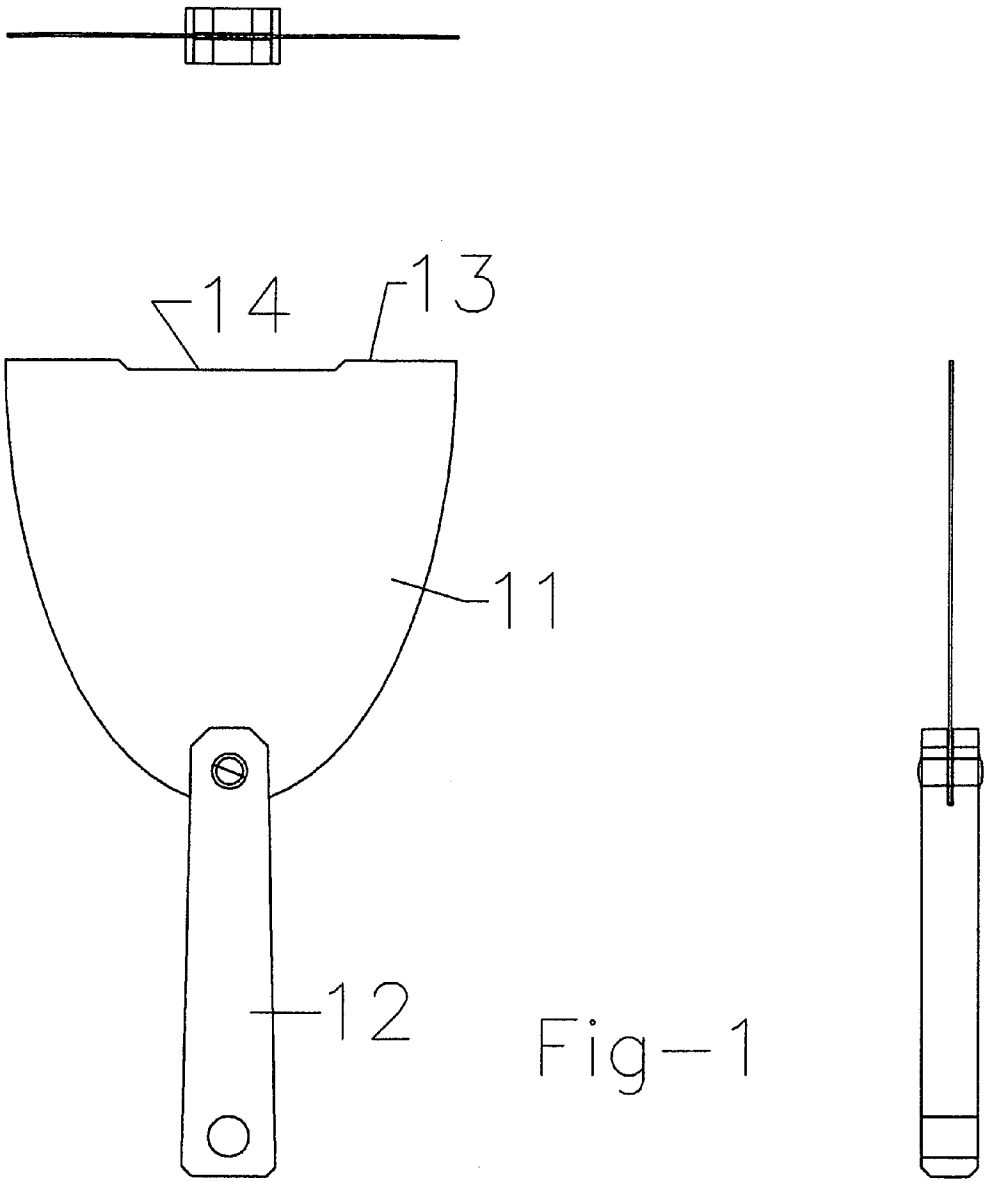

This invention relates to a drywall tool, specifically to use on drywall, sheet rock and cement board where a flat smooth even joint is required. More specifically it relates to a hand tool and method for spreading drywall compound or plaster and leaving a fixed height and width of plaster over a joint between two sections of drywall.

2. Description of Prior Art

Difficulty of obtaining a smooth flat uniform surface between the joints and butt ends of drywall boards, gypsum boards, sheet rock boards, cement boards & other construction boards is well known in the industry. All of these and similar boards are described herein as "drywall boards" for the purposes of these specifications. A reliable and easy method along with a tool to spread the drywall compound, cement, grout, plaster, etc, to obtain this flat surface has been the search of the construction industry for a long time. All of these compounds and similar compounds are described herein as "joint compound" for the purposes of this specification.

In an ideal situation and in skilled hands with experience a worker, one could spread joint compound properly over a drywall board joint and obtain, in most cases, a very flat and acceptable joint. The problem in industry today is that the ideal conditions and the skilled workers are a variable today especially in the rapidly expanding housing and commercial industries. By ideal conditions one would want the drywall boards to be nailed or screwed flat to the studs so that each section of board is at the same level as the board next to it which would allow for a uniform thickness of joint compound to be applied. In most construction applications, these ideal conditions do not which always occur causing the joint surface to have valleys and hills that makes creating a constant depth of joint compound become difficult. This creates a challenge to the worker to obtain a smooth and flat surface because the two drywall board surfaces are at two different heights. Usually to compensate for this problem a skilled worker knows to apply several thin layers of joint compound. This method requires a lot of time to complete because each layer of joint compound must dry before the next layer can be applied. It is common to have at least 3 layers and sometimes more to build up the level of compound to obtain a nice flat surface. One of the most commonly used joint compounds requires the worker to wait 24 hours after the first coat is applied before the next before adding an additional coat, according to it's directions. Therefore three coats could take as long as three days or longer just to build up the surface of one joint. Care must be taken not to allow each layer to be too thick since it is common that the joint compound could crack presenting additional difficulties to obtain a smooth flat surface.

The other item effecting ideal joint preparation is spreading the joint compound over a butt end joint. Butt end joints are not recessed and are at the actual height of the wall board.

Applying the tape automatically brings the height of the joint higher than that of the surface of the drywall board. This requires many layers of joint compound to be applied at different widths for each application. It is not unusual to sand the joint surface between each layer to help obtain a flat surface. Sanding the joint creates a lot of fine dust creating an unhealthy environment and possibly a hazardous situation. The worker is required to wear a mask to guard against this dust entering their lungs and of course this process takes additional time above and beyond that of the compound drying time and the time to apply the next coat. Any process that reduces sanding in itself has many benefits.

As mentioned before many events can affect the ideal conditions heeded to obtain smooth flat joints. Even when the conditions are not ideal, a very skilled worker with a lot of experience in most cases can produce a very flat surface. It may require extra days of applying thin layers of compound or extra sanding but these workers will usually get the correct result Their skills are more art than science in obtaining a flat surface. The real problem in the industry is that most workers preparing joints on drywall surfaces do not have this dexterity of hand coordination to obtain good uniform flat joints when ideal conditions are not met and sometimes even when ideal conditions are present.

The industry has been in search of a tool and method to turn the art of getting a flat smooth drywall joint from an art to more of a science. A tool where a semi-skilled or even unskilled worker can get a flat smooth joint under any conditions. The following examples illustrate some known hand tools that attempt to accomplish this task; U.S. Pat. No. 2,800,672 to Gilyan (1957) discloses a tool for plastering joints. This is a combination tool which includes a straight edge blade and a curved blade. The idea is that the curved blade can be used first over the joint and then the straight edge can be used to feather the joint by adding another layer of joint compound. It is known in the industry that a curved blade does not result in a good smooth & flat joint. Usually a curved blade allows for an excessive amount of joint compound and cracking of the compound can occur during curing. In addition such a wide curve requires a steady hand to stay within the recess joints of two boards. If a worker allows the curve blade to leave the recessed area, it creates more difficulty to obtain a smooth joint. This usually requires a lot of sanding to level the high spot.

U.S. Pat. No. 2,934,936 to Vernon (1960) discloses various tools call taping trowels. One tool in particular again utilizes the curved blade concept. Actually two different curves on each side of the hand trowel. The concept is to apply an inner coat using the first smaller width, larger radius curve to to fill the joint with joint compound and after curing use the other side which has a wider width, smaller diameter curve to apply the next outer joint. Again this has similar problems as the prior patent and is not used in current techniques.

U.S. Pat. No. 3,878,581 to Perna (1974) is a variety of finishing tools for wallboard surfaces. In particular is one tool that is made up of several rigid & non-flexible plates with a laminated elastomeric blade of rubber or composite. This again has a curved blade concept as part of this combination tool and would have similar problems as the other two patents mentioned above.

U.S. Pat. No. 4,654,919 to Liberman (1987) discloses a spreader tool to apply plaster to wallboard. This tool is different than the above mentioned tools in the fact that the blade edge is flat like a normal trowel and is not cut as a curve. Instead the blade is bent into a curve position thus allowing for a worker to apply a "curved" layer as the trowel is angled and after curing, the edges of the curved compound joint could be feathered smooth using the straight edge of the blade. Actually this would be a harder to use product than the first three patents mentioned because as the tool is angled to obtain the curve, if the angle of the tool changes, the thickness of the curve would also change. The industry has determined that a curved first coat does not lead to a better joint. In most cases it creates more problems.

Finally U.S. Pat. No. 6,606,758 B1 to Fridman (2003) discloses a serrated tool for plaster over a surface joint. This products uses a trowel that has two sets of serrated edges on both of the blade ends and a cut out notch with straight edges of 3 to 4 inches. This tool, to get good results, is to be held at a 35 to 45 degree angle when using it to cover the tape. The tool when spreading compound would create a squared extrude area in the center and smaller extruded triangle rows of joint compound at the serrated edges. The tool being large would require a steady hand while covering a wide area. The serrated edges will build up joint compound on the flat part of the drywall board, only requiring more joint compound to be applied to smooth those edges This requires much more finishing sanding and time for the worker.

Objects & Advantages

Accordingly, these and other known tools of prior art fail to address the main problem of obtaining smooth flat joints using a simple method to overcome the skill required of a worker and when ideal conditions are not met. Therefore the need for a simple low cost tool and method to obtain flat, even joints of drywall is desired in the industry and has not been solved. This is why today you still see a flat edge trowel being used in the industry instead of any of the other inventions mentioned.

The invention I detail has several objects and advantages;

(a) very low cost available in a polymer or steel construction
(b) a tool that is simple to use even with an unskilled worker or a do-it-yourself homeowner
(c) a tool that uses a smallest amount of joint compound to obtain the proper joint and requires only the smallest amount of sanding in the final process.
(d) a tool that can be utilized when drywall board is applied with uneven surfaces and on butt joints and still obtain a smooth flat joint surface
(e) a tool to speed up the finished surface preparation from several days to with in 48 hours or less.

SUMMARY

In accordance with the present invention a drywall tool resulting in flat even joints comprised of a trowel with a handle and blade. The blade is notched in the center and the rest of the blade is flat with a straight edge to spread the joint compound over the joint and drywall tape to allow for an easy method to obtain a flat extruded bead with square edges as a simple first step to match even and uneven drywall board joints, using the minimal amount of joint compound, resulting in easy use by unskilled workers and minimal finishing sanding.

DRAWINGS

In the drawings a more detailed and complete appreciation of the present invention and various advantages can be realized by reference to the detailed description that will accompany the drawings in which:

FIG. 1: is the invention showing the drywall trowel with flat surface on both ends of the blade and a flat notch with straight edges that allows for a flat extruded build up of joint compound to an exact desired height to occur over the drywall joint and tape while the flat end will remove any excess joint compound.

FIG. 2A to FIG. 2E: shows the method steps where in the first process step the drywall tool is used and the other steps that occur to create an even joint.

REFERENCE NUMERALS IN DRAWINGS

11 blade
12 handle
13 flat edge of blade
14 notch
15 dry wallboard
16 tapered edge of drywall board
17 drywall tape
18 edge of two drywall boards
19 depth of joint compound after use of invention
20 filled in of the flat extruded surface and sides
21 final coat of joint compound if necessary

DETAILED DESCRIPTION

Description—FIG. 1—Drywall Tool

A detailed description of the preferred embodiment of the present invention follows with reference to accompanying drawings in which elements are indicated by reference numerals. In FIG. 1, the blade 11 is a flat and straight edge with no curves. The blade can be metal or polymer materials that is attached to a handle 12 made of similar or dissimilar materials and made to be molded with the blade or attached separately. The blade 11 is designed to be larger than the two recessed edges of the dry wall board for optimal use. The edge of the blade 11 is located opposite of the handle and consists of three different areas; two flat straight edges 13 on each side of the blade and in the center area a notched section 14. The two flat edges 13 will remove and spread joint compound along the joint when moved parallel to the joint. The notched section 14 will allow for a flat amount of joint compound to remain on the joint of a certain height with straight edges. The height and width will be fixed to the specific height and width desire to equal that of the final surface of joint which is that of the height of the drywall board. The optimal width can vary between of 2 to 3 inches sized to cover the drywall tape. The notch depth is most effective at a height of 1/16 to 1/8 of an inch but can vary as much as 1/4 of an inch. Once cured the second step will use a standard straight edge drywall trowel to fill in each side of the resulting valley between the drywall and the extruded flat surface created by the invention.

FIGS. 2A-2E Method of Drywall Tool and Completing the Process

Figure 2A:
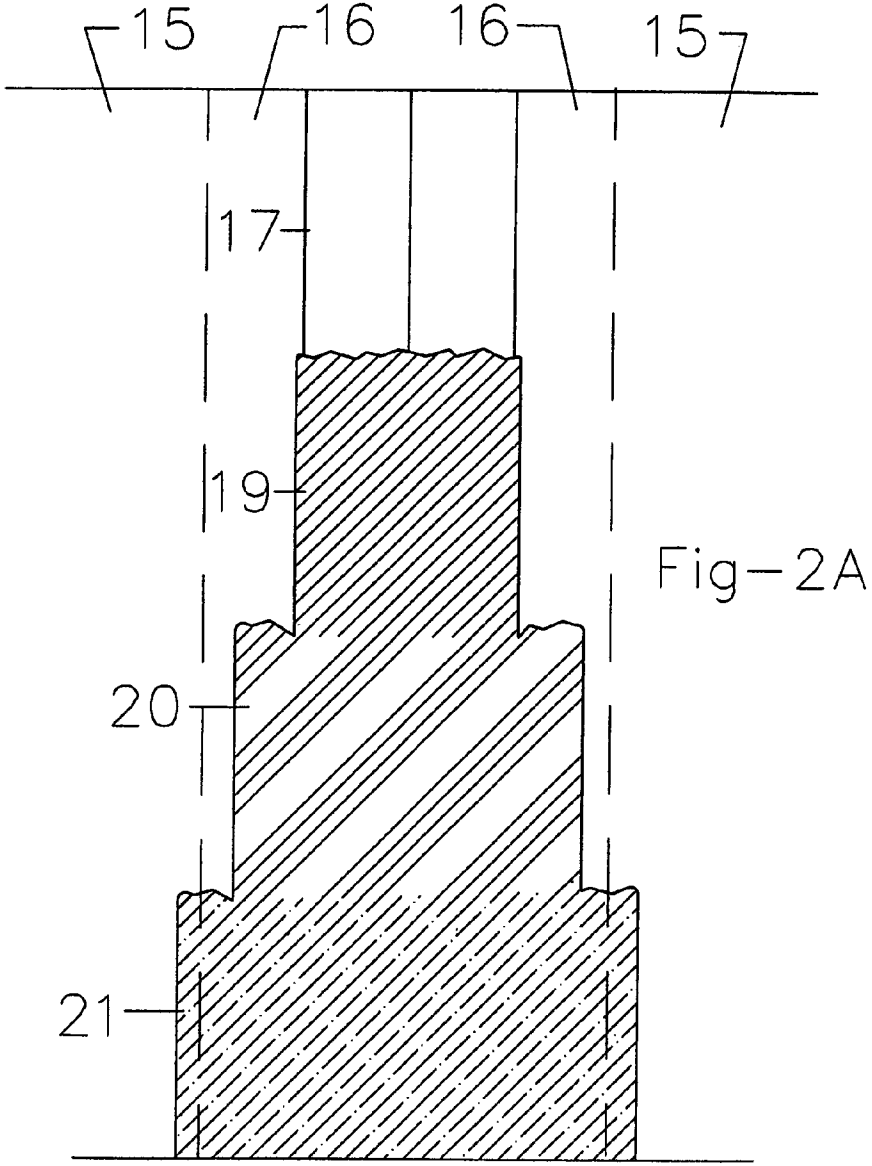
Figures 2B, 2C, 2D, 2E:
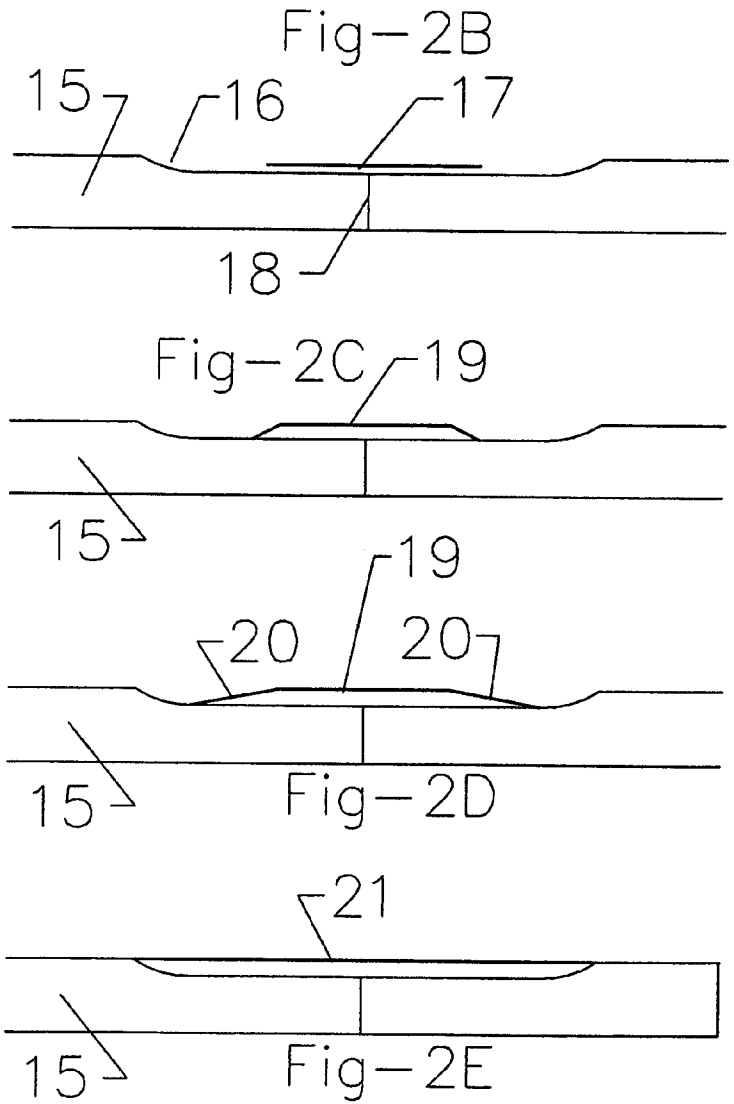

The method of the drywall tool and finishing process of the joint is show in detail in FIG. 2A and FIG. 2B. Two drywall boards 15 of a certain thickness are placed side by side creating a joint. The drywall edges 16 are usually recessed where the drywall tape 17 is applied in the center of the joint created by the two drywall boards 15.

In FIG. 2A and FIG. 2C the drywall tool loaded with joint compound is applied over the drywall tape 17 and moved paralleled with the drywall joint leaving a flat extruded amount of drywall compound 19 in the drywall board recessed area 16. The two edges of the blade of the drywall tool will remove all the dry wall compound from the recessed area leaving behind a flat extruded surface of drywall compound with straight edges of a fixed height 19. The first step of the process is completed and an amount of time is given for the joint compound to dry and cure.

In FIG. 2A and FIG. 2D shows the next step after curing has occurred. With a typical straight edge putty knife or blade, a second coat is applied to fill the recessed areas between the drywall 15 and the extrude surfaced made earlier by the invention. This filled area is labeled 20 and should completely fill the drywall recessed area 16. This area can be filled completely in this step but depending on the situation a third skim coat 21 may be applied with a wider straight edge trowel or putty knife to fill any remaining vallies. This process allows for a continuous filling of the recessed areas or small valleys eliminating any need for rigorous sanding to smooth joints between coating. Typically a very light sanding may be required after the final coat to adjust the surface appearance to reflect the same look as the drywall board. The amount of sanding, if required, is very small producing limited dust compared to traditional methods currently being utilized and creates a better environmental condition for the worker.

Advantages

From the description above a number of advantages of my drywall tool resulting in flat even surfaces is evident;

(a) low cost available in a polymer or steel construction
(b) a tool that is simple to use even with an unskilled worker or a do-it-yourself homeowner
(c) a tool that uses a small amount of joint compound to obtain the proper joint and requires only the smallest amount of sanding in the final process
(d) a tool that can be utilized when drywall board is applied with uneven surfaces and on butt joints and still obtain a smooth flat joint surface
(e) a tool to speed up the finished surface preparation from several days to with in 48 hours or less.
(f) a simple method that produces flat even surfaces every time.

Operation—FIGS. 2A-2E, 1

The manner of using the drywall tool resulting in flat even joints can be described as a two, sometimes three, step process where the worker simply takes the tool holding the handle 12 and filling the blade 11 with joint compound then move the blade across the tape into the recessed area in a side ways manner spreading drywall compound in the recessed area Then placing notched 14 between the recess joint 16 on the drywall board over the drywall tape 15. Moving the blade 11 parallel over the drywall tape 17 will leave an extruded amount of drywall 16 on the tape and recessed through the notch 14 of the blade 11.

The flat edges 13 of the blade 11 will remove any drywall compound in the recessed area allowing for a flat extruded amount of compound to remain over the tape of a certain height. This process will continue over all joints and when finished the worker will allow the joint compound to cure. Once cured the worker will fill the remaining area with joint compound with a regular straight edged trowel. A final skim coat can be applied to fill in any remaining valleys giving a flat even surface of the joint.

Conclusion, Ramifications, and Scope

Accordingly, the reader can see this is a very simple tool to be used yet consistently yields excellent flat smooth joints. There has been a strong interest by manufacturers who produce these tools to have exclusive rights to bring this tool to commercial use. Trial after trial by various level of skilled workers and do-it yourself home owners have yielded excellent results with this dry wall tool and method. The industry recognizes the difficulty of obtaining flat even joints and the problems that occur when the joint is not smooth in the finished product.

The invention I detail has several advantages; very low cost to manufacture the product making it available to everyone. A tool that is simple to use even with an unskilled worker or a do-it-yourself homeowner. A tool that uses a small amount of joint compound to obtain the proper joint and requires only the smallest amount of sanding in the final process. A tool that can be utilized when drywall board is applied with even and uneven surfaces along with butt joints and still obtain a smooth flat joint surface. A tool to speed up the finished surface preparation from several days to with in 48 hours or less.

I claim:

1. A handheld tool for spreading plaster consisting of:

a flat blade with a first end and a second end that is opposite the first end, the first end of the blade is attached to a separate handle, and the second end of the blade comprises a straight edge with a notch located in the center, the notch forms two edges of equal widths on opposite sides of the notch on the straight edge of the second end of the blade, the second edge of the blade is approximately 6 inches wide, and the center notch comprises a flat bottom surface that is parallel to the straight edge of the second end of the blade and side edges that taper inwardly from the straight edge of the second end of the blade to the flat bottom surface of the notch, and the notch is approximately 3/16 inches deep, and the flat bottom surface is approximately 3 inches wide.

2. The handheld tool for spreading plaster as recited in claim 1, wherein the two edges on opposite sides of the notch are approximately 1.5 inches in width.

* * * * *